United States Patent [19]

Kennedy

[11] 4,436,234

[45] Mar. 13, 1984

[54] FRAME FASTENER

[75] Inventor: George W. Kennedy, Pompano Beach, Fla.

[73] Assignee: Senco Southeast, Inc., Decatur, Ga.

[21] Appl. No.: 284,607

[22] Filed: Jul. 20, 1981

[51] Int. Cl.[3] ..... B27F 7/34

[52] U.S. Cl. ..... 227/4; 227/7; 227/153; 227/30

[58] Field of Search ..... 269/41; 227/4, 7, 30, 227/148, 151, 152, 153, 124, 40

[56] References Cited

U.S. PATENT DOCUMENTS

| | | | |
|---|---|---|---|
| 199,579 | 1/1878 | Rose . | |
| 1,664,687 | 4/1927 | Jensen . | |
| 2,209,379 | 7/1940 | Bell | 227/152 X |
| 2,903,699 | 9/1959 | Mazzola . | |
| 3,112,105 | 11/1963 | Keller . | |
| 3,266,361 | 8/1963 | Gravenhorst et al. . | |
| 3,804,316 | 4/1974 | Kay | 227/40 |
| 3,898,906 | 8/1975 | Greenberg . | |
| 4,126,259 | 11/1978 | Galer et al. . | |
| 4,127,226 | 11/1978 | Jasper . | |
| 4,258,873 | 3/1981 | Vela | 227/30 X |

*Primary Examiner*—Mark Rosenbaum

*Attorney, Agent, or Firm*—George M. Thomas

[57] ABSTRACT

A clamp assembly 11 holds two frame elements 2, 3 in a common plane and in angled abutment to form a mitered joint 1. A fastener tool 13 is held with its discharge opening 125 positioned on one side of the location where the mitered joint is to be formed, and a brace 88 is positioned on the other side, with the brace being movable toward and away from the location of the mitered joint. A toggle lock 87 locks the brace against the mitered joint. Control means fire the fastener tool in response to the frame elements being clamped and braced. The fastener 168 is inserted into the mitered joint at an angle to draw the mitered joint together.

9 Claims, 10 Drawing Figures

FRAME FASTENER

BACKGROUND OF THE INVENTION

This invention relates to a method and apparatus for fastening together frame elements, such as the frame elements of a picture frame.

In the production of frames of the type used to mount pictures or mirrors and similar objects, and in the production of panel doors for kitchen cabinets and of the frames for the door openings, the elongated frame elements usually are formed with end surfaces oriented at angles with respect to the longitudinal axis of the frame elements with the grain of the wood extending along the length of each frame element and the angled end surfaces of a frame element is matched together with a similar angled end surface of an adjacent frame element to form a mitered joint, and the frame elements are connected together by a fastener. In most instances the mitered joints will be 90° joints that form the frame elements in a rectangular shape; however, other angles and shapes can be formed.

One process used for fastening mitered joints is to insert at least one nail into the outer edge surface of one frame element through that frame element, through the mitered joint, and into the adjacent frame element. As the fastener is driven through the mitered joint, the force applied to the fastener and to the frame elements tends to compress or draw together the mitered joint. A second fastener can then be driven from the edge surface of the adjacent frame element through the mitered joint, and this usually forms a firm connection between the frame elements. Some disadvantages of this type connection procedure are that the head portions of the fasteners are visible at the edge of the frame when the frame is hung on a wall, or if the fasteners are counter sunk into the frame elements the holes or the putty covering the holes are visible, a multiple number of fasteners are required for each joint to form a stable frame, there is a hazard that the fasteners will hit each other as they are driven into the frame, and if the frame is held in a jig and fasteners are driven simultaneously through both the frame elements at the corner of the frame, two fastener tools are required for the process.

Another process for joining frame elements together in a mitered joint is to place the angled end surfaces of the frame elements together to form the mitered joint and then to insert a staple or similar fastener into the back surfaces of the frame elements at a right angle with respect to the surfaces of the frame elements so that the fastener straddles and therefore connects together the frame elements. Since the movement of the fastener into the surfaces of the frame elements usually does not tend to draw the frame elements together, the firmness of the connection between the frame elements depends upon the operator's technique, and if the operator is not diligent in pressing the frame elements together during the fastening procedure, a loose joint is formed.

Another process for joining frame elements together in a mitered joint is to form a kerf in each frame element adjacent the mitered joint on the unexposed surfaces of the joint, with the kerfs extending parallel to the angled end surfaces of the frame elements and then inserting a clamp into the kerts. A disadvantage of this process is that it requires additional labor and time, and therefore is expensive.

A recently developed apparatus functions to hold the angled frame elements together to form an abutting mitered joint and to insert a fastener to the joint from the back surface of the frame at an angle sloped toward the inside of the frame. The fastener is shaped so that it tends to draw the joint together as it enters the frame material. The sharpness of the fasteners and the force and direction in which the fasteners are to be inserted into the frame elements require safety features to be included in the apparatus so as to avoid injury to the operator of the apparatus.

SUMMARY OF THE INVENTION

Briefly described, the present invention comprises a frame fastener for connecting together the frame elements of frames such as picture frames, cabinet molding, and panel doors for cabinets, and to form mitered joints at the corners of a frame, wherein the frame elements are placed in and held by a clamp assembly so that the angled end surfaces of the frame elements are held in abutment with each other, and a fastener is inserted into the back or normally unexposed surfaces of the frame elements. The fastener straddles the joint between the frame elements at an angle from the unexposed surface near the outer corner of the joint and is sloped toward the inside of the angle formed at the corner of the frame joint.

The clamp assembly includes stationary clamp elements for holding the inside surfaces of the frame elements and movable clamp elements that move toward and away from the inside clamp elements for bearing against the outside edges of the frame elements and urging the frame elements toward the stationary clamp elements and urging the end surfaces of the frame elements into abutment with each other. A brace is movable against the outside surfaces of the frame elements at the joint opposite the surfaces of the frame elements into which the fastener is to be inserted, and the fastener tool is positioned with its discharge opening at the plane where the frame elements are to be located when gripped by the clamp assembly. The movable clamp elements are actuated by pneumatic cylinders, and a pressure responsive switch responds to the gripping by the movable clamp elements of the frame elements and to the engagement of the brace against the outside surfaces of the frame elements at the joint to actuate the fastener tool, so that the fastener tool does not discharge a fastener unless the frame elements are properly gripped and braced in the clamp assembly.

Thus, the frame elements are characterized by having their angled end surfaces pressed together in a mitered joint and with their upper surfaces braced in a common plane as a fastener is inserted at an angle sloped with respect to the back surfaces of the frame elements toward the inside of the angle formed by the frame elements, thus tending to draw the joint together.

Therefore, it is an object of this invention to provide a frame fastener for rapidly and accurately connecting together the angled end surfaces of frame elements to form a mitered joint in a frame structure substantially without hazard to the operator.

Another object of this invention is to provide a frame fastener which safely and accurately forms tight mitered joints in frame structures, with the fastener for the joints straddling the joints and extending through the back surfaces of the frame elements at an angle sloped toward the inside of the angle formed by the frame elements.

Another object of this invention is to provide a method and apparatus for forming frame elements in a mitered joint, in which frame elements are gripped and urged together in a mitered joint, and in which the frame elements are braced at the mitered joint in a common plane, and in response to the gripping and bracing of the frame elements a fastener is inserted into the surface of the joint opposite to the braced surface.

Another object of this invention is to provide a frame fastener for connecting together the mitered joints of picture frames and the like, wherein the movable clamp elements of a clamp assembly are urged against the frame elements of the picture frame by pneumatic cylinders and a brace abuts the mitered joint, and in response thereto, a fastener tool discharges a fastener that penetrates the surfaces of the frame elements at the mitered joint to connect the frame elements together.

Another object of this invention is to provide a method and apparatus for rapidly, safely and reliably connecting together the frame elements of a picture frame or the like in a firm mitered joint so that the fasteners are inserted through the back or unexposed surfaces of the picture frame and the fasteners are not visible when the frame is hung on a wall surface and the operator is protected from improper alignment of the frame elements and from accidental firing of a fastener from the fastener tool.

Other objects, features and advantages of the present invention will become apparent upon reading the following specification, when taken in conjunction with the accompanying drawings.

DETAILED DESCRIPTION

Figure 1:
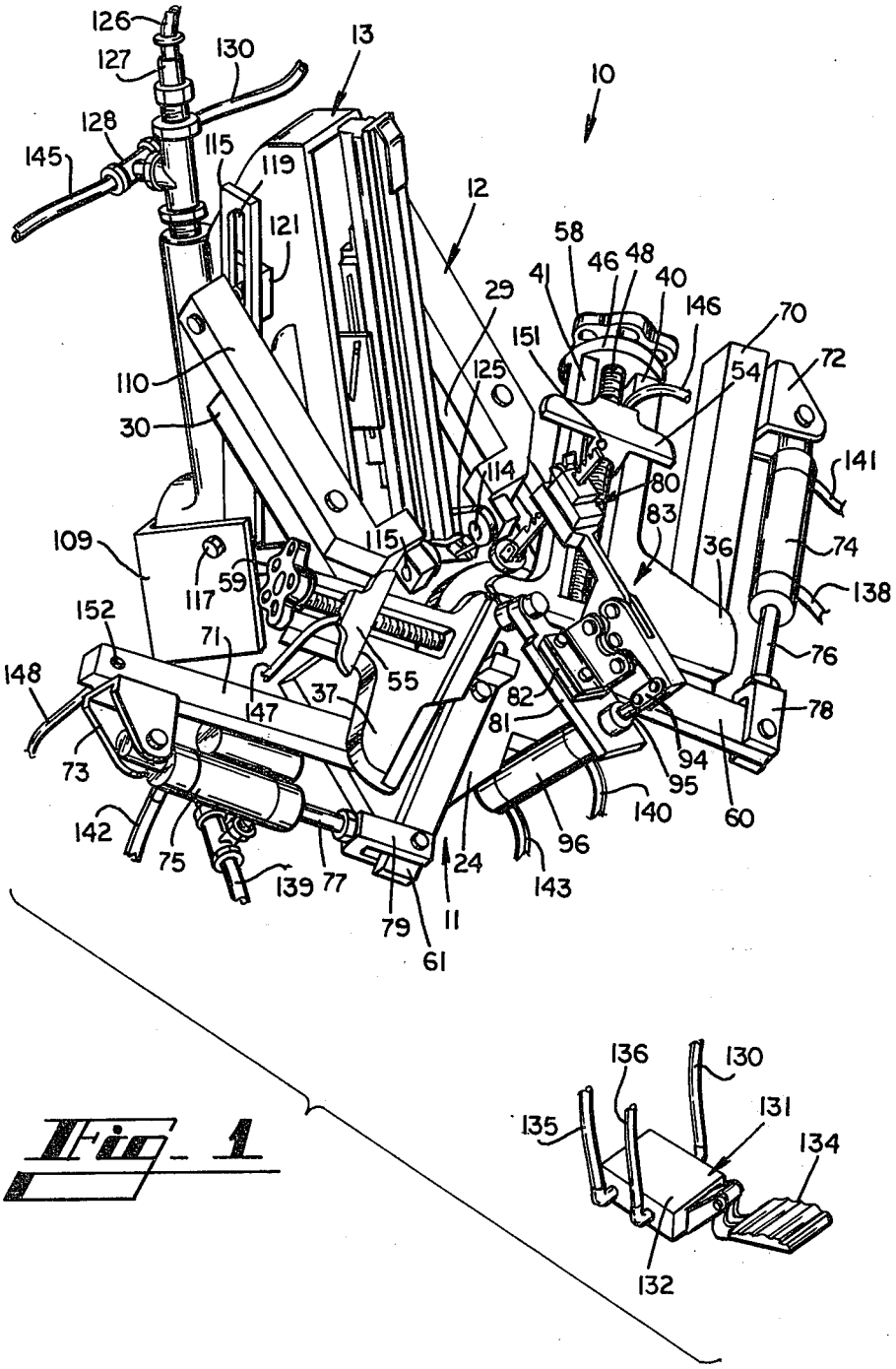
FIG. 1 is a perspective illustration of the frame fastener assembly.
Figure 5:
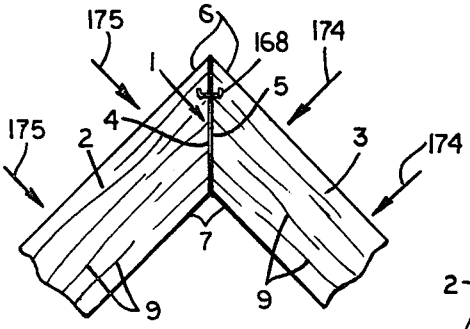
FIG. 5 is a detail illustration of a mitered joint of a rectangular frame formed by the frame fastener assembly.
Figure 6:
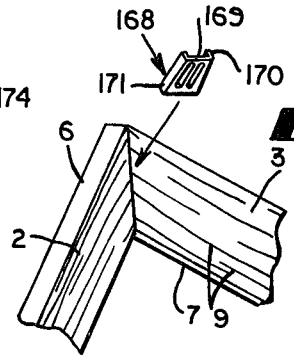
FIG. 6 is a perspective illustration of a mitered joint of a rectangular frame formed by the frame fastener assembly, showing the angle at which a fastener is inserted into the mitered joint.

Referring now in more detail to the drawings, in which like numerals indicate like parts throughout the several views, FIGS. 5 and 6 illustrate a right angle mitered joint 1 of a rectangular frame, such as a picture frame, which includes elongated wooden frame elements 2 and 3 each having 45° end surfaces 4 and 5 in abutment with each other to form a mitered joint. The frame elements 2 and 3 have an outer peripheral surface 6, an inner edge surface 7, a back or unexposed surface 8 and a front or decorative surface. The grain of the wood 9 extends along the length of the frame elements 2 and 3. FIG. 1 illustrates the frame fastener 10 which is used to form the mitered joints of FIGS. 5 and 6 and includes a right angle clamp assembly 11, fastener tool cradle 12 and fastener tool 13. As illustred in FIG. 3, right angle clamp assembly 11 includes support stand 15 having a base plate 16 defining openings 18 therethrough for rigid connection of the base plate to a work table, and upwardly extending clevis 19. Tiltable support plate 20 includes downwardly projecting clevis 21 which is connected to clevis 19 by means of pivot pin 22 and a set screw 23.

Mounting plate 24 has its lower surface placed in flat abutment with the upper surface of tiltable support plate 20, and pedestal 25 of the clamp assembly has its lower surface in flat abutment with the top surface of mounting plate 24. Pedestal 25, mounting plate 24 and tiltable support plate 24 are rigidly connected together by means of bolts or similar fasteners (not shown), so that the mounting plate and pedestal are tiltable with respect to the work table (not shown) on which the frame fastener is mounted.

Mounting plate 24 is approximately rectangular but includes V-shaped notch 26 at its front edge and U-shaped notch 28 at its rear edge. Cradle braces 29 and 30 are rectilinear in shape and are rigidly mounted in spaced parallel relationship with respect to each other in a common plane and are rigidly attached to the upper surface of mounting plate 24, as by welding. Each cradle brace 29 and 30 includes an elongated slot 31, 32, and slots 31, 32 are parallel to each other and oriented vertically.

Right angle clamp assembly 11 includes a pair of work supports 34 and 35 oriented at right angles with respect to each other and which define work surfaces 36 and 37 in a common plane. Work supports 34 and 35 are rigidly mounted to pedestal 25, and each work support 34, 35 includes travel screw extension 38, 39, each of which includes a pair of parallel legs 40, 41, and 42, 43 that extend parallel to one another with the legs 40, 41 extending at a right angle with respect to the legs 42, 43. The parallel legs 40, 41, 42, 43 define travel screw slots 44, 45 respectively, and heads 46, 47 are mounted at the ends of legs 40, 41 and 42, 43. Travel screws 48, 49 extend through openings in heads 46, 47.

A stationary clamp element 50, 51 is formed on each work support 34, 35, with each clamp element protruding above the work surfaces 36, 37 and in alignment with a travel screw 48, 49. The travel screws 48, 49 extend through openings in the stationary clamp elements 50, 51, such as opening 52, and movable clamp elements 54, 55 are positioned in sliding relationship on parallel legs 40, 41 and 42, 43, with each movable clamp element defining an internally threaded opening therethrough, such as opening 56 of clamp element 54. The external surface of travel screw 48 is formed with a helical thread extending thereabout which engages the threads of openings 56 of each movable clamp element 54, 55, so that when each travel screw is rotated, its movable clamp element 54, 55 moves toward or away from the stationary clamp element 50, 51. The travel screws 48, 49 can be rotated manually by rotating the handles 58 or 59 that are connected to the outer ends of the travel screws.

Clamp lever arms 60, 61 are each pivotally mounted intermediate their ends by pivot pins 62, 63 (FIG. 2) to mounting plate 24. The clamp lever arms are oriented approximately at a right angle with respect to each other, with their inner ends each including a cleat 64, 65 (FIG. 3), with each cleat including a pair of protrusions 66. The end portions of the travel screws 48 and 49 that protrude through the stationary clamp elements 50, 51 are undercut at 68, 69, and the protrusions of the cleats 62, 63 straddle the undercut portions 66, 67 of the travel screw. Thus, when the clamp lever arms 60, 61 are pivoted about their pivot pins 62, 63, the travel screws 48, 49 reciprocate along their lengths through the openings 52 of stationary clamp elements 50, 51, thus reciprocating the movable clamp elements 54, 55.

Figure 2:
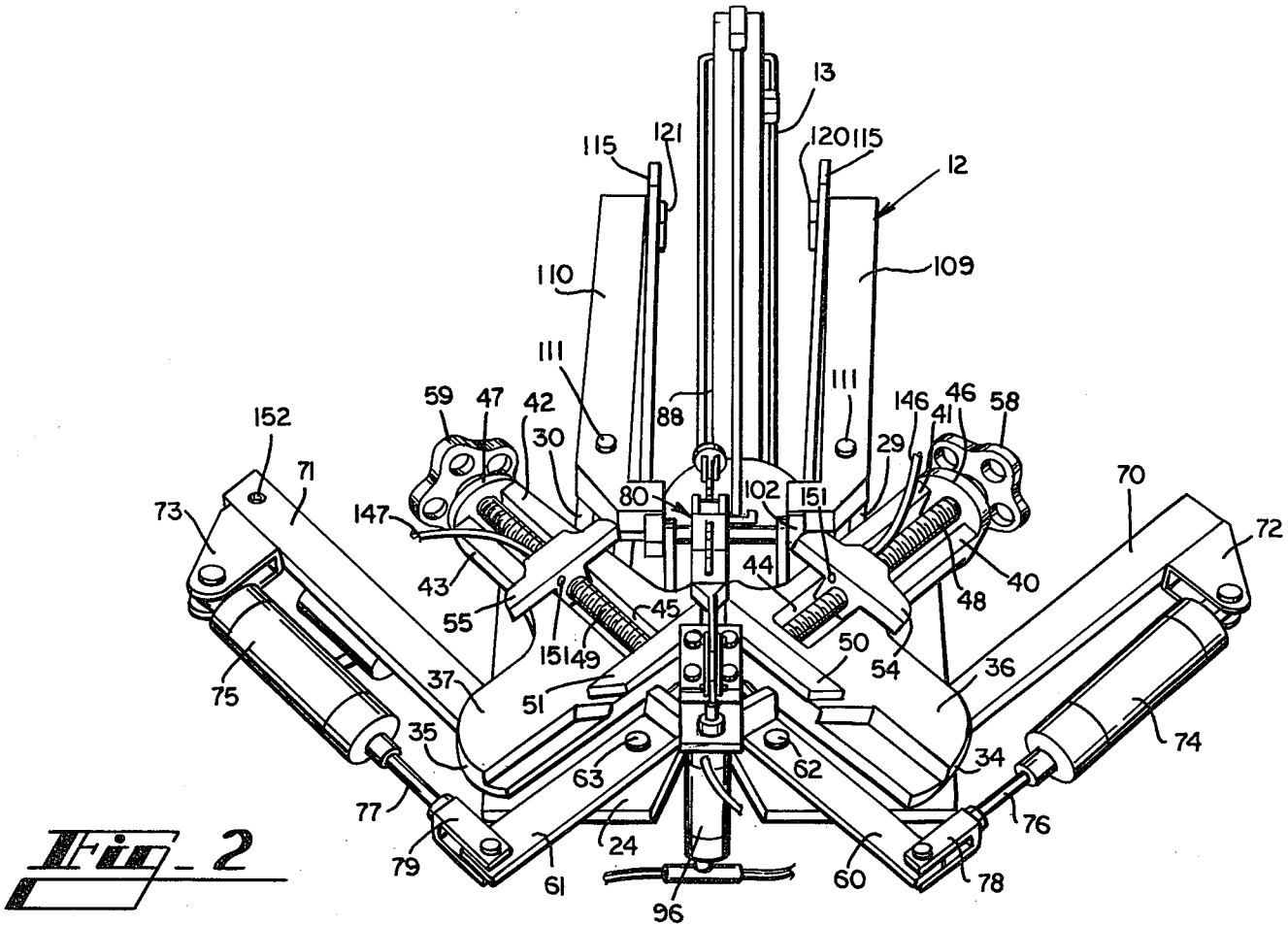
FIG. 2 is a front view of the frame fastener assembly.

As illustrated in FIG. 2, cylinder support arms 70 and 71 are each rigidly mounted at their inner ends to mounting plate 24 and are oriented at a right angle with respect to each other. Each cylinder support arm 70, 71 includes a clevis 72, 73 at its upper end, and a fluid actuated cylinder 74, 75 is supported at one end by clevis. The cylinder rod 76, 77 of each cylinder 74, 75 has a connector clevis 78, 79 mounted thereto, and each connector clevis is pivotally mounted to the distal end of a clamp lever arm 60, 61. The cylinders 74, 75 are double acting cylinders and function to oscillate the clamp lever arms 60, 61 about their pivot pins 62, 63, to reciprocate the travel screws and to move the movable clamp elements 54, 55 toward or away from the stationary clamp elements 50, 51.

Figure 9:
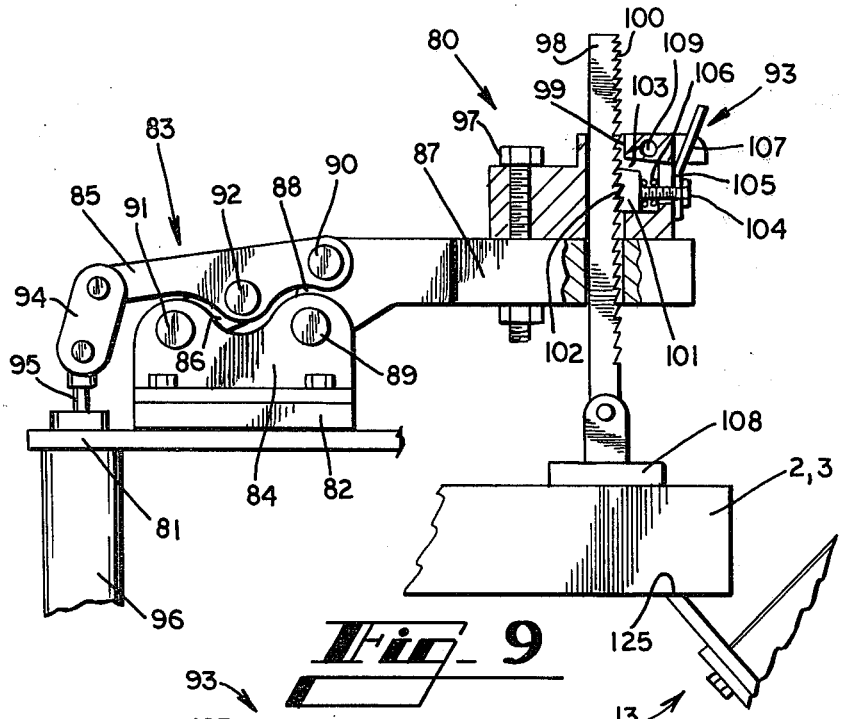
FIG. 9 is a side elevational view of the brace and its toggle lock in its locked position and a cross-sectional view of the ratchet and pawl assembly.
Figure 10:
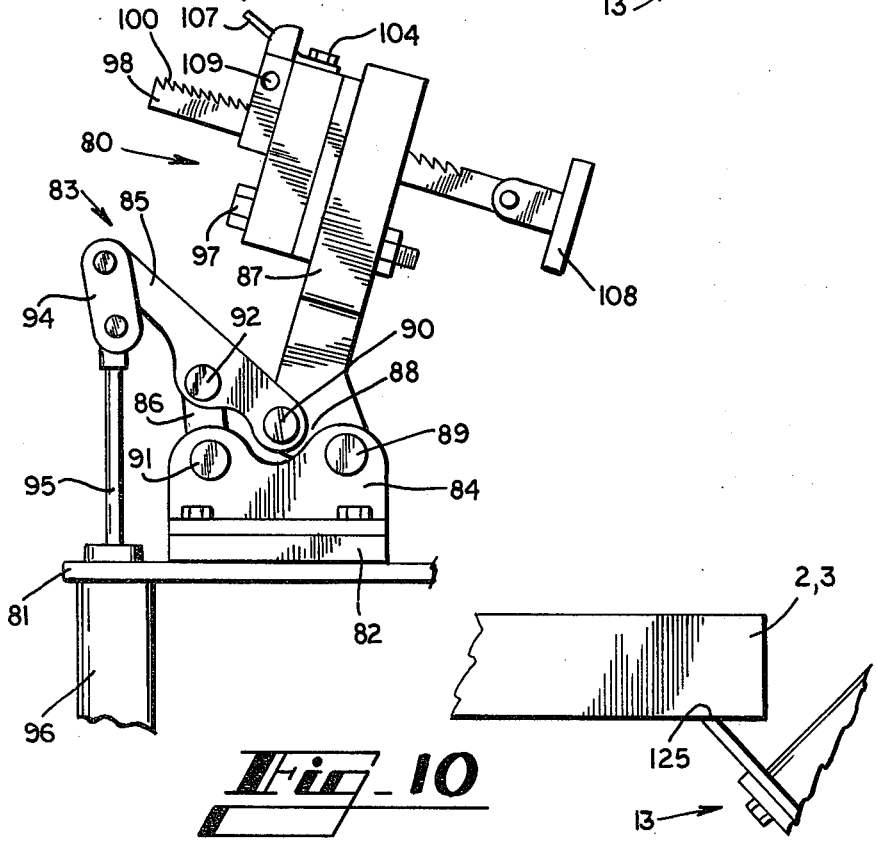
FIG. 10 is a side elevational view similar to FIG. 9, but showing the toggle lock in its unlocked position.

As illustrated in FIGS. 9 and 10, frame brace assembly 80 (FIGS. 1 and 3) includes mounting strap 81, built-up platform 82 positioned on mounting strap 81 and toggle lock 83 supported on built up platform 82. Toggle lock 83 includes a support element in the form of a double-ended clevis 84, actuating link 85, lock link 86, and support arm 87 which includes at one end a support arm link 88. Support arm link and the support element are pivotably connected together at a first stationary pivot pin 89, the actuating link 85 and support arm link are pivotably connected together at a first movable pivot pin 90 which moves about the first stationary pivot pin 89, the lock link 86 and the support element 84 are pivotably connected together at a second stationary pivot pin 91, and the actuating link 85 and the lock link are pivotably connected together at a second movable pivot pin 92 which moves about the second stationary pivot pin 91. The distal end of actuating link 85 is connected by means of swivel 94 to cylinder rod 95. Cylinder rod 95 extends through mounting strap 81 and into pneumatic cylinder 96. Pneumatic cylinder 96 is a double-acting cylinder, and when it reciprocates its cylinder rod 95, actuating link 85 rocks about rock link 86 so as to oscillate support arm 87 about stationary pivot 89 (FIG. 10).

Socket assembly 93 is mounted on the distal end of support arm 87 by bolt 97 extending through aligned openings of the socket assembly and the support arm, and stem 98 extends through socket opening 99. Stem 98 includes a series of ratchet teeth 100 along one surface thereof, and pawl 101 includes mating teeth 102. Pawl 101 is positioned in pawl cavity 103 of socket assembly 93, and cap screw 104 is threaded partially into the back surface of pawl 101 and extends out of socket assembly 93 through slot 105. Coil compression spring 106 surrounds screw 104 and biases pawl 101 toward engagement with the ratchet teeth 100 of stem 98. Lever 107 has a bifurcated end that extends about screw 104 and is tiltable to partially withdraw screw 104 through slot 105 and to disengage pawl teeth 102 from ratchet teeth 100. The slope of the teeth of the ratchet and pawl permit the stem to move downwardly when the pawl engages the ratchet teeth but prevents the stem from moving upwardly unless the pawl is withdrawn from the ratchet teeth. Brace foot 108 is mounted on the lower end portion of stem 98 and has a flat bottom surface for flat abutment with the frame elements across the mitered joint, to hold the surfaces of the frame elements in a common plane. Air duct 109 extends from the outside of socket assembly 93 to the upper wall surface of pawl cavity 103. The pawl cavity is larger than pawl 101, so that the pawl can move a short distance with stem 98 as the stem moves along its length through socket opening 99. This lost motion of the stem and pawl causes pawl 101 to function as a valve to close air duct 109 when pawl 101 has moved to block air duct 109. When pawl 101 has moved away from air duct 109, air can move through the duct 109, into pawl cavity 103 and out through slot 105 to the atmosphere.

Figure 3:
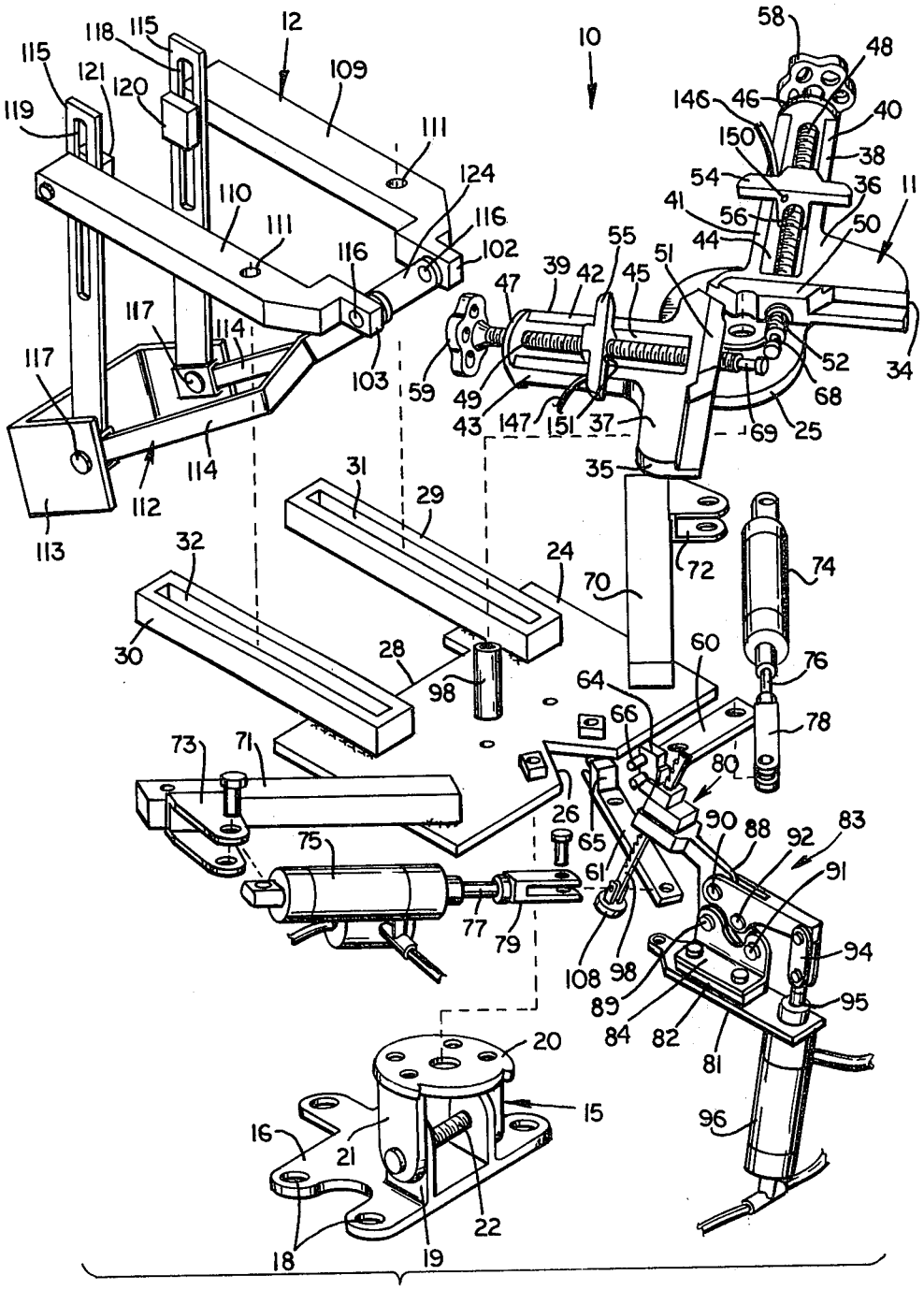
FIG. 3 is an exploded perspective illustration of the frame fastener assembly with the fastener tool removed therefrom.

As illustrated in FIGS. 1–3, fastener tool cradle 12 comprises parallel support arms 109, 110 that are angled inwardly at their lower ends. Fastener openings 111 extend through the support arms 110 and fasteners such as bolts extend through the openings 111 and through the slots 31, 32 of the cradle braces 29, 30, so that the support arms 109, 110 rest in flat abutment on cradle braces 29, 30, and can be repositioned along the cradle braces, as necessary.

Cradle yoke 112 includes base 113, side legs 114 and slide bars 115. Side legs 114 are each pivotally connected to the ends of support arms 110 by pivot pins 116, slide bars 115 are pivotally connected at their lower ends to base 109 by pivot pins 117 and the upper end portions of slide bars 115 define adjustable slot openings 118 and 119. Bolts 120 and 121 extend through the slots 118 and 119 and into the distal ends of support arms 109 and 110 and releasably connect the slide bars 115 to the support arms 109 and 110. Thus, the attitude of the cradle yoke 112 with respect to support arms 110 can be adjusted by loosening bolts 120 and 121 and sliding the slide bars 115 about the bolts and then tightening the bolts.

The upper portions of side legs 114 are received in the U-shaped slot 28 of mounting plate 24. Fastener tool 13 rests in and is mounted to fastener tool cradle 12 by placing the head portion of the fastener tool in the cradle yoke 112 with the discharge opening 125 of the fastener tool located between the pivot pins 115. The fastener tool usually is rigidly connected in the fastener tool cradle 12 by bolts extending through base 113 into the tool.

As illustrated in FIG. 1, the arrangement is such that the discharge opening 125 of fastener tool 13 is placed immediately below the plane of work surfaces 36, 37 in the space adjacent the intersection of the work surfaces. In will be noted that if the fastener tool 13 is tilted with respect to the plane of the work surfaces 36, 37, by adjusting slide bars 115 with respect to support arms 110, the cradle yoke 113 pivots about the pviot pins 115, and the axis of rotation of the pivot pins 115 extends approximately through the discharge opening 125 of the fastener tool 13. Thus, the fastener tool can be pivoted substantially without moving discharge opening 125 with respect to the plane of the work surfaces 36, 37.

Additionally, if the cradle yoke and fastener tool are moved closer to or further away from the right angle clamp assembly 11, by loosening the bolts through openings 111 of support arms 110 and through the slots 31 and 32 of cradle braces 29 and 30 and sliding the support arms 110 with respect to the cradle braces, the discharge opening 125 moves in a plane parallel to the plane of the work surfaces 36 and 37 since the cradle braces 29 and 30 and support arms 110 extend parallel to the plane of the work surfaces 36, 37.

Figure 4:
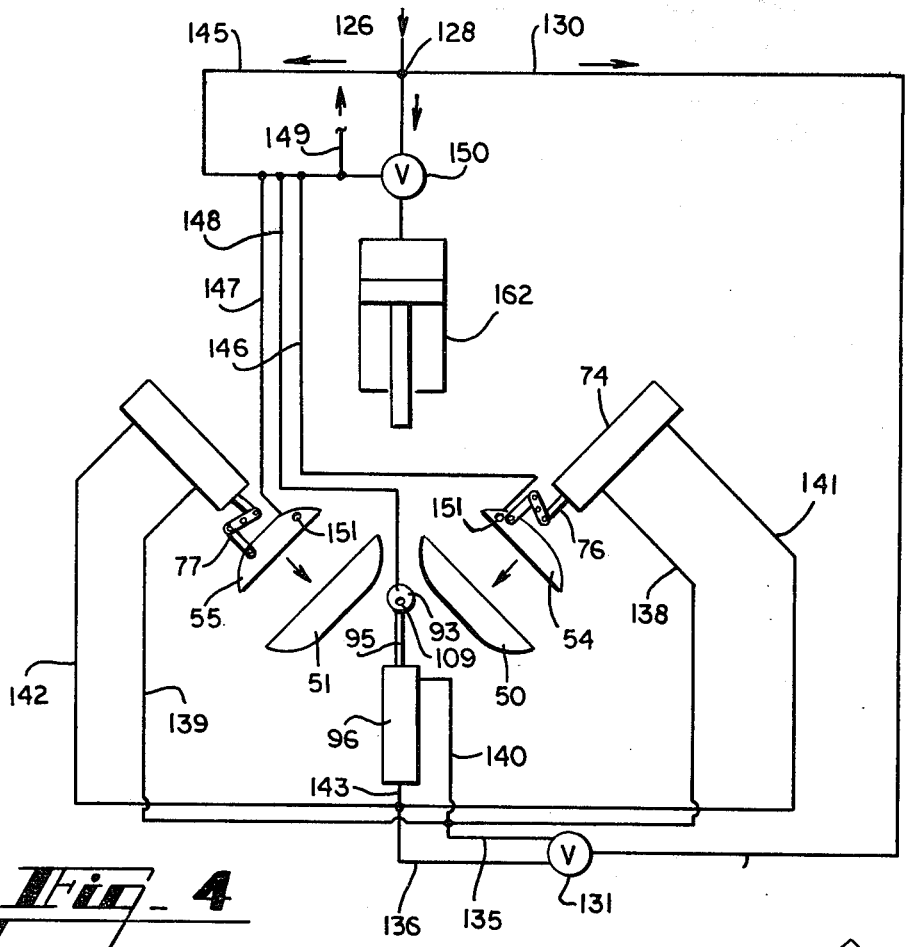
FIG. 4 is a schematic illustration of the pneumatic control system for the frame fastener assembly.

As illustrated in FIGS. 1 and 4, air under pressure is supplied to frame fastener assembly 10 through a conduit 126 from a compressor (not shown) connected to fitting 127, with the air communicating directly with the plenum (not shown) within fastener tool 13. The T-connector 128 communicates with fitting 127 and with air supply conduit 130 so as to supply the pressurized air to one side of foot control valve 131. Foot control valve 131 is located on the floor at the operator's position adjacent frame fastener 10 and includes valve housing 132 and pedal 134 pivotally mounted to the housing 132. The valve spool (not shown) is positioned within valve housing 132 and controls the supply of air pressure from air supply conduit 130 to air control conduits 135, 136.

As illustrated in FIG. 4, air conduit 135 communicates with branch conduits 138, 139 and 140, and these conduits each communicate with one end of a pneumatic cylinder 74, 75 and 96, so that when pressure is received in a branch conduit 138–140, each cylinder retracts its cylinder rod 76, 77 and 95. This tends to close the movable clamp elements 54 and 55 toward the stationary clamp elements 50 and 51 and to move the brace foot 108 toward the plane of work surfaces 36 and 37 of the right angle clamp assembly 11. When the pedal of valve 131 is raised, air under pressure is supplied from air supply conduit 130 through valve 131 to the other air conduit 136, through branch conduits 141, 142 and 143, thus reversing the pressure exerted on pneumatic cylinders 74, 75 and 96, distending their cylinder rods 76, 77 and 95, thus causing movable clamp elements 54 and 55 to move away from stationary clamp elements 50 and 51 and causing brace foot 108 to pivot away from the plane work surfaces 36 and 37.

T-connector 128 is also connected to air supply conduit 145, and air supply conduit 145 is connected to branch conduits 146, 147, 148 and 149, and air supply conduit 145 is also connected to control valve 150. Branch conduits 146 and 147 each communicate through an opening 151 (FIGS. 2 and 3) formed through each of the movable clamp elements 54 and 55, respectively, branch conduit 148 is connected to air duct 109 (FIG. 9) of socket assembly 93, and branch conduit 149 exhausts to the atmosphere through air opening 152 formed through cylinder support arm 71. The arrangement is such that the air under pressure moving through air supply conduit 145 communicates with control valve 150, but the air is also continuously bled to the atmosphere through conduits 146, 147, 148 and 149.

When the operator depresses foot pedal 134 (FIG. 1), pneumatic cylinders 74 and 75 function to move movable clamp elements 54 and 55 into clamping relationship with respect to frame elements such as frame elements 2 and 3 and frame brace 80 pivots its brace foot 108 into flat abutment across the upper surface of the miter joint formed by the frame elements. The engagement of the movable clamp elements against the frame elements blocks the air openings 151 and 152 through the movable clamp elements 54 and 55 so that the flow of air through branch conduits 146 and 149 is substantially retarded. Also, if the foot 108 (FIG. 9) of frame brace 80 makes firm contact with the frame elements 2, 3, the stem 98 tends to move through the socket opening 99 of the socket assembly 93 with enough lost motion to cause pawl 101 to move to the top of pawl cavity 103. This results in the pawl prohibiting further lost motion of the foot and stem and a force is applied to the frame members. Also, the pawl 101 blocks air duct 109 so that the flow of air to air duct 109 through branch conduit 146 is retarded. However, air is still bled to the atmosphere through branch conduit 149 and air opening 152 in cylinder support arm 71. If the operator covers the air opening 152 with his finger, air pressure is then built up in control valve 149 to a pressure sufficient to actuate the control valve 150, causing a supply of air to be fed to the cylinder 162 of fastener tool 13, whereupon the fastener tool discharges a fastener from its discharge opening 125.

As illustrated in FIG. 9, it is desirable to have foot 108 move into flat abutment with the frame elements 2, 3. Pawl 101 can be withdrawn from ratchet teeth 100 of stem 98 to cause the flat abutment when lock toggle 83 is in its locked condition as shown in clamped relationship with the clamp elements, the lock formed by the toggle lock will not permit the frame elements to move upwardly. Moreover, the lock is formed by the toggle lock as the pawl 101 moves to cover air duct 109. Therefore, the locking of the brace assembly is accomplished as the air duct is blocked, so that the fastener tool will not discharge a fastener until the brace assembly is locked and the the foot applied in braced relationship against the frame members.

As illustrated in FIGS. 5 and 6, the frame elements 2 and 3 are rectilinear elements each having their end portions 4 and 5 formed at a 45° angle, and the angled end portions are placed in abutment with each other, causing the frame elements to form a 90° angle with respect to each other. This forms a 90° mitered joint, and a fastener, such as fastener 168, is inserted into the joint by fastener tool 13. The particular fastener 168 illustrated herein is approximately U-shaped in cross-section and is of a breadth sufficient to straddle the joint formed between the rectilinear frame elements. Fastener 168 includes central web 169 and side flanges 170 and 171, with openings 172 formed in central web 169. The fastener is inserted into the back surface of the frame elements, from beneath the frame as the fastener is discharged from the discharge opening of the fastener tool 13, with one flange 170 located on one side of the seam of the joint and with the other flange 171 on the other side of the seam of the joint. The fastener 168 is inserted at an inclined angle with respect to the back surfaces of the frame elements so that it is inclined toward the inside of the right angle formed by the frame elements.

Figure 7:
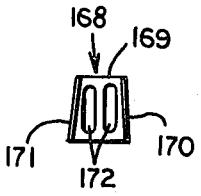
FIG. 7 is a side elevational view of a fastener of the type used in forming the picture frames with the frame fastener assembly of FIGS. 1–4.
Figure 8:
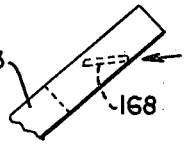
FIG. 8 is a detail edge view of the corner of a frame, showing the brace foot and the fastener inserted in the corner of the frame.

When the movable clamp elements 54 and 55 are moved under the influence of pneumatic cylinders 74 and 75 to clamp the frame elements 2 and 3 against the stationary clamp elements 50 and 51, the forces applied to the edge surfaces of the frame elements 2 and 3 are illustrated by the arrows 174 and 175 (FIG. 5). The forces tend to urge the 45° angle end surfaces 4 and 5 toward each other so that a firm abutment of the angled end surfaces will be present when the frame elements are securely clamped in the right angle clamp assembly 11, just prior to the insertion of a fastener 168 into the mitered joint. In addition, the brace foot also pivots toward the mitered joint so that the surfaces of the joint are further urged toward a common plane and the frame elements are braced against the impact of the fastener 168 as the fastener enters the frame elements. Since the flanges 170 and 171 of the fastener (FIG. 7) are tapered, and since the fasteners 168 are inserted at an angle sloped toward the inside of the right angle formed by the frame elements (FIG. 8), the flanges 170 and 171 tend to be deflected apart from each other as they engage the grain 9 of the wood, thereby tending to draw the grain together. Therefore the frame elements are drawn together as the fastener enters the material of the frame elements, thus assuring firm abutment of the frame elements.

While this invention has been described in detail with particular reference to a preferred embodiment thereof, it will be understood that variations and modifications can be effected within the spirit and scope of the invention as described hereinbefore and as defined in the appended claims.

I claim:

1. In apparatus for fastening mitered joints of a frame comprising a clamp assembly for holding two frame elements in a common plane and in angled abutment with each other to form a mitered joint, means for moving said clamp assembly into clamping engagement with the frame elements, support means for supporting a fastener tool with its fastener discharge opening at a position on one side of the common plane at a location where the mitered joint is to be positioned and at an attitude to discharge a fastener into the mitered joint, the improvement comprising a brace member movable into engagement with the frame elements at the mitered joint clamped by said clamp assembly on the other side of the common plane, said brace member including a foot with a surface movable into engagement with both frame elements at the mitered joint to brace the frame elements in a common plane, a stem connected at one of its ends to said foot, a socket member movably mounted to said stem, and said socket member and stem including means for limiting the movement of said foot and stem with respect to said socket member as the foot engages the frame elements, means for moving said brace member into engagement with the mitered joint, and control means responsive to the movement of the stem and the socket member with respect to each other as the foot engages the frame elements to discharge a fastener from the fastener tool.

2. The apparatus of claim 1 and wherein said brace member includes lock means for locking said brace member in engagement with the mitered joint.

3. Apparatus for fastening the joint of a frame comprising clamp means for holding two frame elements in a common plane and in angled abutment with each other to form a joint, support means for supporting a fastener tool with its fastener discharge opening at one surface of the joint on one side of the common plane and directed toward the common plane, brace means movable into abutment with a surface of the joint opposite to said one surface and on the other side of the common plane, control means responsive to the movement of the brace means into abutment with the joint for actuating the fastener tool, said brace means comprising a foot, a stem extending from said foot, said stem including a series of ratchet teeth, a socket member surrounding said stem whereby the stem is movavle through the socket member toward the frame elements, and a pawl member carried by said socket member in releasable engagement with the ratchet teeth of said stem for selectively preventing movement of the stem and foot away from the frame elements.

4. The apparatus of claim 3 and wherein said pawl member is movable with respect to said socket member in response to said root engaging the joint, and wherein said control means includes means for detecting the movement of said pawl member.

5. Apparatus for fastening the joint of a frame comprising clamp means for holding two frame elements in a common plane and in angled abutment with each other to form a joint, support means for supporting a fastener tool with its fastener discharge opening at one surface of the joint on one side of the common plane, brace means movable into abutment with a surface of the joint opposite to said one surface and on the other side of the common plane, and control means responsive to the movement of the brace means into abutment with the joint for actuating the fastener tool, said brace means comprising a support arm, a foot member supported by said support arm and movable in unison with said support arm toward engagement with the frame elements, actuating means for moving said suport arm, said actuating means including a toggle lock, said toggle lock including a support element, and actuating link, a lock link and a support arm link, said support arm link and said support element pivotally connected together at a first stationary pivot, said actuating link and said support arm link pivotably connected together at a first movable pivot which moves about said first stationary pivot, said lock link and said support element pivotably connected together at a second statinary pivot, and said actuating link and said lock link pivotably connected together at a second movable pivot which moves about said second stationary pivot, whereby when said second movable pivot is moved to a position in alignment with the first movable pivot and the second stationary pivot, the support arm is locked against pivotable movement about the first stationary pivot.

6. Apparatus for fastening the joint of a frame comprising clamp means for holding two frame elements in a common plane and in angled abutment with each other to form a joint support means for supporting a fastener tool with its fastener discharge opening at one surface of the joint on one side of the common plane and directed toward the common plane, brace means movable into abutment with a surface of the joint opposite to said one surface and on the other side of the common plane, control means responsive to the movement of the brace means into abutment with the joint for actuating the fastener tool, said brace means comprising a foot member, lost motion support means for movably supporting said foot member and for urging said foot member into engagement with the frame elements with the foot member movable with respect to said lost motion support means upon engagement of said foot member with the frame elements, and wherein said control means comprises means for detecting the movement of said foot member with respect to said lost motion support means.

7. The apparatus of claim 6 and wherein said brace means further comprises lock means for locking said foot member in abutment with the frame elements of the joint.

8. The apparatus of claim 6 and wherein said means for detecting the movement of said foot member with respect to said lost motion support means comprises an air conduit extending through said lost motion support means, air pressure supply means in communication with said air conduit, and means for opening and closing said air conduit upon movement of said foot member with respect to said lost motion support means.

9. The apparatus of claim 6 and wherein said control means is further responsive to said clamp means being in clamped relationship with the frame elements to actuate the fastener tool.

* * * * *